US006479770B2

(12) United States Patent
Dahl et al.

(10) Patent No.: US 6,479,770 B2
(45) Date of Patent: Nov. 12, 2002

(54) ELECTRICAL SWITCH

(75) Inventors: Joerg-Uwe Dahl, Werder (DE); Marc Liebetruth, Glienicke (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/941,728

(22) Filed: Aug. 30, 2001

(65) Prior Publication Data

US 2002/0056619 A1 May 16, 2002

(30) Foreign Application Priority Data

Aug. 31, 2000 (DE) ..... 100 44 058

(51) Int. Cl.[7] ..... H01H 9/20

(52) U.S. Cl. ..... 200/50.21; 200/50.26; 200/318; 200/325

(58) Field of Search ..... 200/50.01, 50.02, 200/50.12, 50.21, 50.23, 50.24, 50.26, 400, 401, 318, 323, 324, 325

(56) References Cited

U.S. PATENT DOCUMENTS 4,769,739 A * 9/1988 De Bruin ..... 200/50.1
4,806,710 A * 2/1989 Kalvaitis et al. ..... 200/50.12
5,945,648 A * 8/1999 M'Sadoques ..... 200/43.14
6,144,002 A * 11/2000 Coudert et al. ..... 200/400
6,252,186 B1 * 6/2001 Liebetruth et al. ..... 200/43.01

FOREIGN PATENT DOCUMENTS

| | | | |
|---|---|---|---|
| DE | A1-3642719 | 6/1988 | ..... H01H/73/02 |
| DE | A1-19826200 | 12/1999 | ..... H02B/11/133 |
| WO | A2-9965124 | 12/1999 | |

OTHER PUBLICATIONS

Festlegungen, Deutsche Elektrotechnische Kommission im DIN und VDE (DKE), p. 7 Feb. 1986.

* cited by examiner

*Primary Examiner*—Michael Friedhofer
(74) *Attorney, Agent, or Firm*—Harness, Dickey & Pierce P.L.C.

(57) ABSTRACT

An electrical switch includes a switching contact arrangement, an interchangeable release block and a locking element. A first operating surface is formed on the locking element, which can be moved from a locked position to an unlocked position. The first operating surface allows the release block to be secured from being removed from the switch, when the locking element is in its locked position.

11 Claims, 2 Drawing Sheets

ELECTRICAL SWITCH

The present application hereby claims priority under 35 U.S.C. §119 of German application number 10044058.4 filed in Germany on Aug. 31, 2000, the contents of which are hereby incorporated by reference in their entirety and for all purposes.

FIELD OF THE INVENTION

The invention relates to a field of basic electrical components and is applicable to the design configuration of an electrical switch. More preferably, the switch includes a release by means of which the movement of a switching contact arrangement of the switch from a closed switch position to an open switch position can be initiated. Still further, the switch preferably includes a locking mechanism for an interchangeable release block, which accommodates the release. By means of the locking mechanism, the release block can preferably be secured to prevent it from being removed from the switch.

BACKGROUND OF THE INVENTION

In a known electrical switch of this type, which is in the form of a manually operated circuit breaker, the locking mechanism has a locking element which can be moved from a locked position to an unlocked position and has a first operating surface by means of which the release block is secured to prevent it from being removed from the switch when the locking element is in its locked position. This locking element is formed by a manual operating toggle, which can be rotated. In this case, when the circuit breaker is operated correctly, the closing of the switching contact arrangement can be initiated by rotating this manual operating toggle into its locked position (ON position). Further, the opening of the switching contact arrangement can be initiated by rotating this manual operating toggle into its unlocked position (OFF position) (DE 36 42 719 A1).

In the event of a serious defect, in which the switching contact arrangement remains closed even though the manual operating toggle is in the unlocked position (OFF position), the fitter who removes the release block is subject to the danger of coming into contact with live parts. Such a defect may be caused, for example, by the welding of the switching contents.

SUMMARY OF THE INVENTION

The present invention is based on an object, for example, of refining the switch such that inadvertent contact with live parts during fitting and removal of the release block is safely precluded.

According to the invention, these and other objects are achieved in that the switch includes a member which reflects the actual switch position of the switching contact arrangement. Further, the locking element preferably includes a second operating surface, which is associated with this member and via which the locking element is fixed in its locked position when the member reflects the closed switch position of the switching contact arrangement.

Such a refinement ensures that the locking element can be moved from its locked position to its unlocked position only when the switching contact arrangement is actually open. This is the only time when the release block can be removed from the switch.

In a further refinement of the invention, the locking element can advantageously be produced by a design refinement of a locking rod which is generally known, for example, from WO 99/65124 and is guided by means of elongated holes parallel to the front surface of the switch into which the release block is inserted, and which can be moved as a function of the actual switch position of the switching contact arrangement. In this case, this locking rod can be fixed in its locked position by means of a stop on a switch position indication, when the switch position indication reflects the closed switch position of the switching contact arrangement. This locking rod allows safety fimctions to be implemented which are intended for protection against incorrect operation. In particular, switch-on prevention can be activated as a consequence of the movement of the locking rod into its unlocked position. Furthermore, a device for insertion and removal of the switch relative to a push-in rack can be blocked and/or closing of the switch can be prevented when the switching contact arrangement is closed or the switch is ready to be switched on. This ensures compliance with essential conditions which are applicable, for example, for what are referred to as "main" switches.

The further refinement of this locking rod which can be provided for the purposes of the invention, provides for the locking rod to have a hook-like projection in order to form the first operating surface, with this first operating surface running parallel to the movement direction of the locking rod. In conjunction with this refinement of the locking rod, it is expedient to provide a tab on the release block, which tab is at right angles to the release block installation direction and behind which the hook-like projection of the locking rod can engage. In this way, it is possible to associate the locking mechanism of the switch with the release block at the side, without having to modify the switch in the region of the release block.

A further refinement of the new locking mechanism provides for the locking rod to have a third operating surface, via which the locking rod can be locked in its unlocked position by means of an interlock element. Such a refinement makes it easier to remove and fit the release block, since the locking rod need not be held in its unlocked position by the fitter. If switch-on prevention is active as a result of the locking rod being in the unlocked position, then the switch cannot be switched on when the locking rod is interlocked in such a manner. In this case, the third operating surface can run at right angles to the movement direction of the locking rod, and the interlock element can be in the form of a spring-loaded catch which rests against the fitted release block, can be supported against the locking rod even when the release block is being detached from the switch, and can be latched into the movement path of the third operating surface when the locking rod is being moved to its unlocked position. Such a refinement ensures that the locking rod can be moved freely when the release block is fitted firmly on the switch.

Further, the scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

An exemplary embodiment of the novel electrical switch is illustrated in FIGS. 1 to 5.

DETAILED DESCRIPTION OF THE PREFERRED EMBODIMENTS

Figure 1:
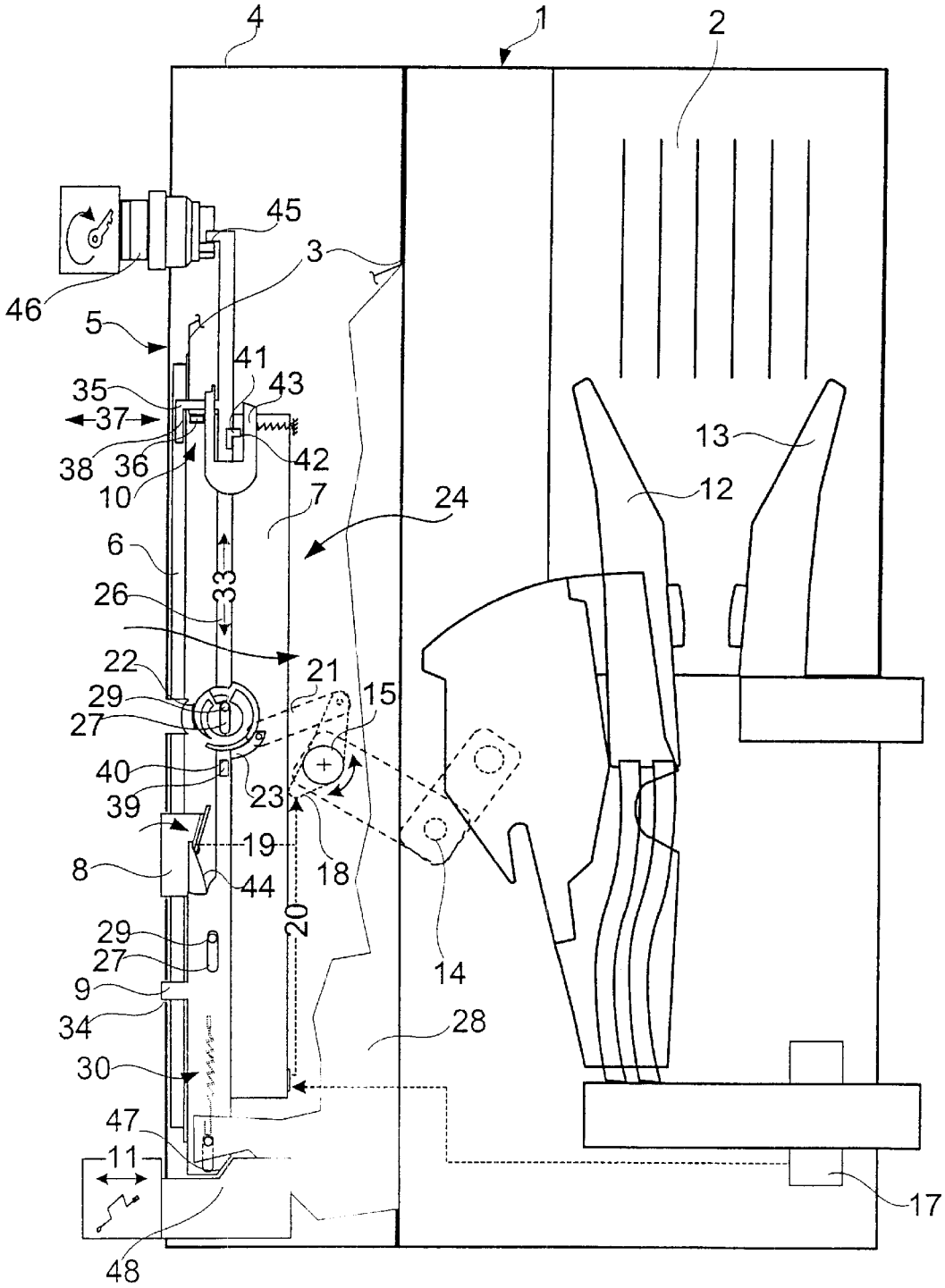
FIG. 1 shows a schematically illustrated section through a low-voltage power breaker with a locking mechanism.

The low-voltage power circuit breaker as shown in FIG. 1 has an arcing chamber 2, which is arranged at the top in a switch enclosure 1, and a control panel 4 which is attached to an enclosure front wall 3. The control area 6 of an electronic overcurrent release, which is arranged in a release block 7, and control and display elements are arranged on a front surface 5 of the control panel 4. The control elements include, inter alia, an OFF key 8 for mechanically switching off the switch, and a control element 9 for operating a locking mechanism 10. The switching device can be moved into and out of a switching cell of a switchgear cabinet (not shown) or a multi-section switchgear assembly, in which the withdrawable frame is located, in the direction of the double arrow 11.

The switch includes a switching contact arrangement which comprises a movable contact lever 12 and a stationary mating contact 13, and which can be operated by means of an operating shaft 15 via a lever arrangement 14. The operating shaft 15 can be pivoted by a drive apparatus in the counterclockwise direction in order to close the switching contact arrangement, and hence to switch the switch ON, and in the clockwise direction in order to open the switching contact arrangement, and hence to switch the switch OFF. Switching the switch OFF can be initiated, for example, mechanically, by means of the OFF key 8, or electrically by means of the electronic overcurrent release, which is coupled to a current transformer 17.

The force transmission and force conversion mechanisms required to pivot the operating shaft in the drive apparatus, which is otherwise not shown in any greater detail but is controlled by the OFF key 8 and by the electronic overcurrent release, are known and are thus illustrated only symbolically in FIG. 1. This is done in the form of the lines of operation 19, 20, which act on a lever arm 18 that is arranged such that it is fixed on the operating shaft. A drum-like indicating apparatus 22 is operated by means of a coupling rod 21 as a consequence of a pivoting movement of the operating shaft 15. A stop 23 is formed on the circumference of this indicating apparatus 22.

The drive apparatus, the locking mechanism 10 and the release block 7 are arranged located alongside one another with respect to the front surface 5 of the control panel 4, in the front region 24 of the switch. In this case, a supporting mechanism which is mounted on the enclosure front wall 3 of the switch is fit both with the drive apparatus and with the locking mechanism. The release block 7 is attached directly to the enclosure front wall 3 of the switch by means of fastening screws 35 (see FIG. 2). The front region 24 of the switch is covered by the control panel 4.

A locking element 26 of the locking mechanism 10 is in the form of a known locking rod and has elongated holes 27, through which two retaining bolts 29 pass, which project from an outer mounting plate 28 of the supporting mechanism. The locking rod 26 can be moved by means of a control element 9, which is formed on the locking rod, between this mounting plate 28 and the release block 7, against the force of a resetting spring 30, from a locked position (see also FIGS. 2 and 3) in the direction of an unlocked position (see FIG. 4). The control element 9 runs at right angles to the movement direction 33 of the locking rod, and passes through a window-like recess 34 in the control panel 4. A first, hook-like projection 35 is also formed on the locking rod 26 and engages behind a tab 36, which projects from the release block 7 and runs at right angles to the installation direction 37 of the release block 7. In this case, the release block is secured by means of a first operating surface 38 to prevent it from being removed from the switch when the locking rod 26 is in its locked position.

A second operating surface 40 which is formed by a second projection 39 on the locking rod is located opposite the stop 23 which is formed on the indicating apparatus 22, when this stop 23 is pivoted into the movement path of this second operating surface 40 as a result of the switching contact arrangement being in the closed switch position. The locking rod further has a third, angled projection 41. This forms a third operating surface 42, via which the locking rod can be locked in its unlocked position by means of an interlock element 43. Finally, the locking rod has further operating surfaces in a known manner, to which a fourth, curved operating surface 44, which is associated with the OFF key 8, a fifth operating surface 45, which is associated with a closing device 46, and a sixth operating surface 47, which is associated with a device for inserting and removing 48 the switch relative to the withdrawable frame, belong.

Figure 2:
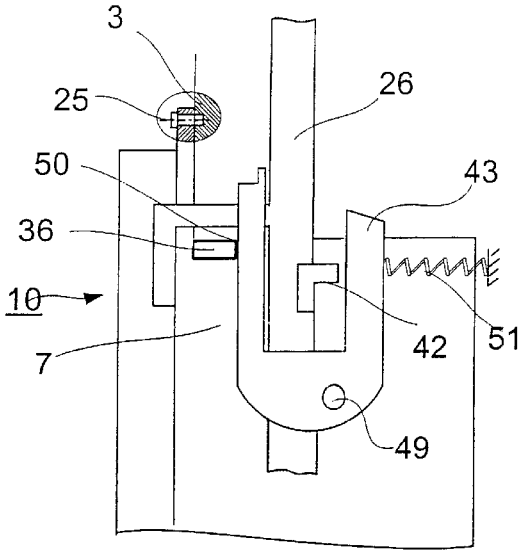
FIGS. 2 to 4 show a first detail of the locking mechanism as shown in FIG. 1 in three phases of its movement sequence.
Figure 3:
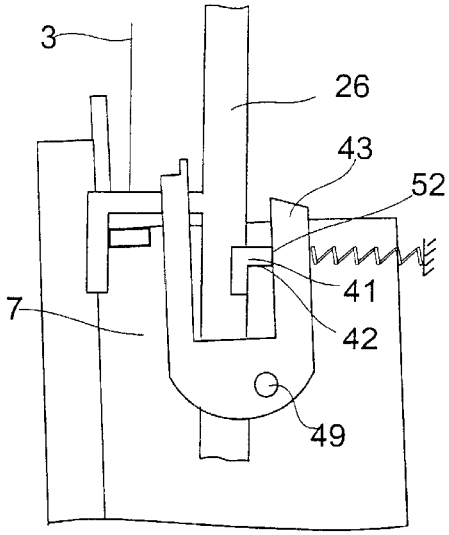
Figure 4:
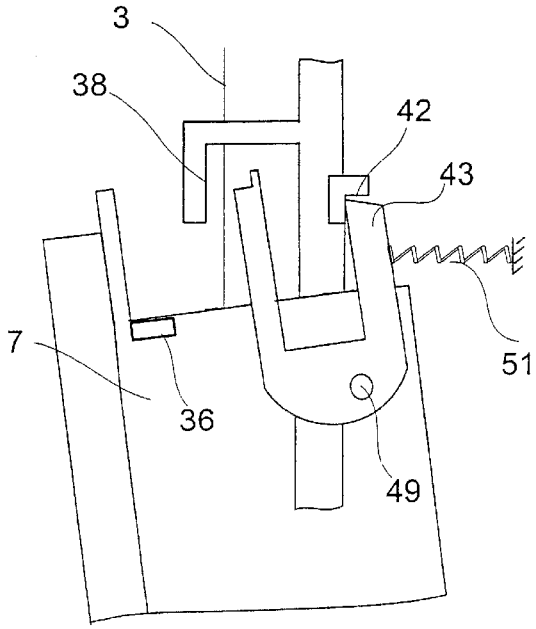

According to FIGS. 2 to 4, the interlock element 43 is in the form of a spring-loaded catch. The catch is fork-shaped and is mounted by means of a stationary bolt 49 such that it can rotate.

According to FIG. 2, which shows a first detail of the locking mechanism 10 in a phase in which the release block 7 is firmly mounted on the enclosure front wall 3 of the switch by means of fastening screws 25, a first section 50 of the circumferential edge of the catch rests against the tab 36 on the release block 7, subject to the force of a spring 51. The catch 43 can therefore not be latched in the movement path of the third operating surface 42 when the locking rod 26 is raised. The locking rod remains freely movable when the release block is firmly mounted.

FIG. 3 shows the first detail of the locking mechanism in a phase in which the release block 7 is partially released from the enclosure front wall 3, but is secured to prevent it from being removed from the switch by the locking rod 26 located in its locked position. In this case, the catch 43 is supported by means of a second section 52 of its circumferential edge on the third, angled projection 41. The locking rod 46 can in this case be latched by means of the third operating surface 42 of the locking rod when the locking rod is moved to its unlocked position, that is to say when the switching contact arrangement is open.

FIG. 4 shows the first detail of the locking mechanism in a phase in which the release block 7 is released from the enclosure front wall 3 of the switch and, by virtue of the locking rod being located in its unlocked position, is released from the first operating surface 38 of the locking rod. The fork-shaped catch is latched in the movement path of the third operating surface 42, thus preventing the locking rod from being reset to its locked position by the influence of the force of the spring 30 (see FIG. 1). The release block can now be removed from the switch. When the release block is reinserted, the catch 43 is pivoted out of the movement path of the third operating surface 42 by the tab 36 on the release block, against the direction of action of the spring 51. As a consequence of this, when the release block reaches the installed position in the switch, the latching of the locking rod in its unlocked position is cancelled once again. The locking rod is then moved to its locked position by the influence of the force of the resetting spring 30. The switch is thus once again ready to be switched on.

Figure 5:
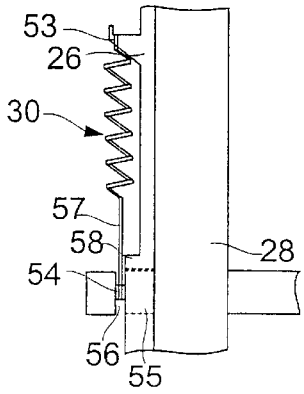
FIG. 5 shows a second detail of the locking mechanism from FIG. 1.

According to FIG. 5, the resetting spring 30 is attached to the locking rod 26 by means of an upper end limb 53. Its lower end limb 54 engages around a third retaining bolt 55 on the supporting mechanism, in the region of an annular groove 56. The lower end limb 54 has a section 57 which runs parallel to the outer mounting plate, with a subregion 58 of the locking rod running between this section 57 and the outer mounting plate 28. The mounting plate and the section 57 of the lower end limb of the resetting spring which runs parallel to it thus form lateral guide surfaces for the locking rod, so that the locking rod is bounded at the sides without any additional bounding element.

In order to improve the operational reliability and safety, the switch has a member 22 which reflects the actual switch position of the switching contact arrangement 12, 13 and which has an associated second operating surface 20 which is formed on the locking element 26. The locking element 26 can be fixed via this second operating surface 40 in its locked position when the member 22 reflects the closed switch position of the switching contact arrangement 12, 13. The locking element 26 may be in the form of a locking rod which is known per se but is provided with an additional hook-like projection 35.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrical switch comprising:

a switching contact arrangement;

an interchangeable release block including a release adapted to initiate movement of the switching contact arrangement from a closed switch position to an open switch position;

a locking element, adapted to secure the release block element, being movable from a locked position to an unlocked position and including a first operating surface adapted to secure the release block from being removed from the switch when the locking element is in a locked position; and a member which reflects an actual switch position of the switching contact arrangement, wherein the locking element includes a second operating surface associated with the member and via which the locking element is fixed in the locked position when the member reflects an actual closed switch position of the switching contact arrangement.

2. The electrical switch as claimed in claim 1, wherein the locking element further includes a locking rod guided by elongated holes, and includes a hook-like projection forming the first operating surface, the first operating surface running parallel to a movement direction of the locking rod.

3. The electrical switch as claimed in claim 2, wherein the release block includes a tab, the tab being at right angles to an installation direction of the release block and wherein the hook-like projection of the locking rod is engagable behind the tab.

4. The electrical switch as claimed in claim 3, wherein the locking rod further includes a third operating surface, via which the locking rod can be locked in the unlocked position using an interlock element.

5. The electrical switch as claimed in claim 4, wherein the third operating surface is at right angles to the movement direction of the locking rod, and wherein the interlock element is in the form of a spring-loaded catch which rests against the release block and which can be supported against the locking rod even when the release block is being detached from the switch, and which can be latched into a movement path of the third operating surface when the locking rod is being moved to the unlocked position.

6. The electrical switch as claimed in claim 5, wherein the interlock element can be positively operated using the release block, by insertion of the release block into the switch in such a manner that, when the release block reaches an installed position in the switch, the locking rod is released from the interlock element and can be moved from the unlocked position to the locked position.

7. The electrical switch as claimed in claim 4, wherein the interlock element can be positively operated using the release block, by insertion of the release block into the switch in such a manner that, when the release block reaches an installed position in the switch, the locking rod is released from the interlock element and can be moved from the unlocked position to the locked position.

8. The electrical switch as claimed in claim 2, wherein the locking rod further includes a third operating surface, via which the locking rod can be locked in the unlocked position using an interlock element.

9. The electrical switch as claimed in claim 8, wherein the third operating surface is at right angles to the movement direction of the locking rod, and wherein the interlock element is in a form of a spring-loaded catch which rests against the release block and which can be supported against the locking rod even when the release block is being detached from the switch, and which can be latched into a movement path of the third opening surface when the locking rod is being moved to the unlocked position.

10. The electrical switch as claimed in claim 9, wherein the interlock element can be positively operated using the release block, by insertion of the release block into the switch in such a manner that, when the release block reaches an installed position in the switch, the locking rod is released from the interlock element and can be moved from the unlocked position to the locked position.

11. The electrical switch as claimed in claim 8, wherein the interlock element can be positively operated using the release block, by insertion of the release block into the switch in such a manner that, when the release block reaches an installed position in the switch, the locking rod is released from the interlock element and can be moved from the unlocked position to the locked position.

* * * * *